US009607458B1

(12) United States Patent
Schleiff

(10) Patent No.: US 9,607,458 B1
(45) Date of Patent: Mar. 28, 2017

(54) SYSTEMS AND METHODS TO MANAGE ACCESS TO A PHYSICAL SPACE

(71) Applicant: The Boeing Company, Chicago, IL (US)

(72) Inventor: Martin Schleiff, Bellevue, WA (US)

(73) Assignee: THE BOEING COMPANY, Chicago, IL (US)

( * ) Notice: Subject to any disclaimer, the term of this patent is extended or adjusted under 35 U.S.C. 154(b) by 274 days.

(21) Appl. No.: 14/027,138

(22) Filed: Sep. 13, 2013

(51) Int. Cl.
*G07C 9/00* (2006.01)

(52) U.S. Cl.
CPC ..... *G07C 9/00031* (2013.01)

(58) Field of Classification Search
CPC ..... G07C 9/00031
USPC ..... 340/5.51, 5.27, 5.31
See application file for complete search history.

(56) References Cited

U.S. PATENT DOCUMENTS 4,463,349 A * 7/1984 Mochida ..... G07C 9/0069 340/11.1
4,916,443 A 4/1990 Barrett et al.
4,988,987 A 1/1991 Barrett et al.
5,495,235 A * 2/1996 Durinovic-Johri ..... G06F 21/31 340/5.27
5,705,991 A * 1/1998 Kniffin ..... G07C 9/00023 340/12.5
6,047,575 A 4/2000 Larson et al.
6,081,199 A 6/2000 Hogl
6,442,983 B1 9/2002 Thomas et al.
6,474,122 B2 11/2002 Davis
6,604,394 B2 8/2003 Davis
6,615,625 B2 9/2003 Davis
6,792,779 B1 9/2004 Shen
6,895,792 B2 5/2005 Davis
6,989,732 B2 1/2006 Fisher
7,009,489 B2 3/2006 Fisher
7,021,092 B2 4/2006 Loughlin et al.
7,178,369 B2 2/2007 Azzalin et al.
7,193,503 B2 3/2007 Fisher
7,209,029 B2 4/2007 Coelho et al.
7,847,675 B1 12/2010 Thyen et al.
8,274,365 B2 9/2012 Piccirillo et al.
2002/0014950 A1 2/2002 Ayala et al.
2003/0179075 A1 9/2003 Greenman
2004/0083374 A1 4/2004 Sugawara
2005/0051621 A1 3/2005 Wong et al.
2005/0125674 A1* 6/2005 Nishiki ..... G07C 9/00031 713/182
2005/0132764 A1 6/2005 Loughlin et al.
(Continued)

FOREIGN PATENT DOCUMENTS

GB 2144483 A 3/1985

*Primary Examiner* — Edwin Holloway, III
(74) *Attorney, Agent, or Firm* — Toler Law Group, PC

(57) ABSTRACT

In one embodiment, a lock comprises a locking mechanism selectively positionable between a locked position and an unlocked position, a user interface to receive a first user input which uniquely identifies a first user, a communication interface to enable electronic communication with a remote computer system and a controller comprising logic to generate a query to a directory service, wherein the query comprises the first user input, and open the locking mechanism in response to a signal from the directory service indicating that that the first user is authorized to open the lock and that a set of conditions required to open the lock are satisfied.

20 Claims, 5 Drawing Sheets

(56) References Cited

U.S. PATENT DOCUMENTS

| | | | | |
|---|---|---|---|---|
| 2005/0210932 | A1 | 9/2005 | Azzalin et al. | |
| 2006/0021003 | A1* | 1/2006 | Fisher | G06F 21/32 726/1 |
| 2006/0170533 | A1* | 8/2006 | Chioiu | G07C 9/00103 340/5.61 |
| 2008/0012690 | A1 | 1/2008 | Friedrich | |
| 2012/0159579 | A1* | 6/2012 | Pineau | G07C 9/00166 726/4 |
| 2012/0218075 | A1* | 8/2012 | Hill | G07C 9/00103 340/5.61 |

* cited by examiner

SYSTEMS AND METHODS TO MANAGE ACCESS TO A PHYSICAL SPACE

RELATED APPLICATIONS

None.

BACKGROUND

Individuals and organizations commonly need to manage access to a physical space for security or other purposes. For example, an organization may need to manage access to different areas of a building or campus, or may need to manage access to objects stored in physical containers, e.g., file cabinets, computer hardware cabinets or the like. Existing access management solutions include conventional key-based or combination locks, which are cumbersome to manage, and enterprise access management systems, which are expensive and require specialized infrastructure.

Accordingly, systems and methods to manage access to a physical space may find utility.

SUMMARY

In one example, a lock comprises a locking mechanism selectively positionable between a locked position and an unlocked position, a user interface to receive a first user input which uniquely identifies a first user, a communication interface to enable electronic communication with a remote computer system, and a controller comprising logic to generate a query to a directory service, wherein the query comprises the first user input, and open the locking mechanism in response to a signal from the directory service indicating that that the first user is authorized to open the lock and that a set of conditions required to open the lock are satisfied.

In another embodiment, a computer-based system to manage access to a physical space comprises a processor, a non-transitory memory comprising logic instructions which, when executed by the processor, configure the processor to receive a query from a lock to a directory service, wherein the query comprises a first user input, authenticate the first user input, and return a signal indicating that that the first user is authorized to open the lock and that a set of conditions required to open the lock are satisfied.

In another embodiment, a method to manage access to a physical space comprises receiving a first user input which uniquely identifies a first user in a user interface of a lock, generating a query to a directory service, wherein the query comprises the first user input, and opening the locking mechanism in response to a signal from the directory service 262 indicating that that the first user is authorized to open the lock and that a set of conditions required to open the lock are satisfied.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

Embodiments of methods, systems, and computer program products in accordance with the teachings of the present disclosure are described in detail below with reference to the following drawings.

DETAILED DESCRIPTION

Systems and methods to manage access to a physical space are described herein. Specific details of certain embodiments are set forth in the following description and figures to provide a thorough understanding of such embodiments. One skilled in the art will understand, however, that alternate embodiments may be practiced without several of the details described in the following description.

Figure 1:
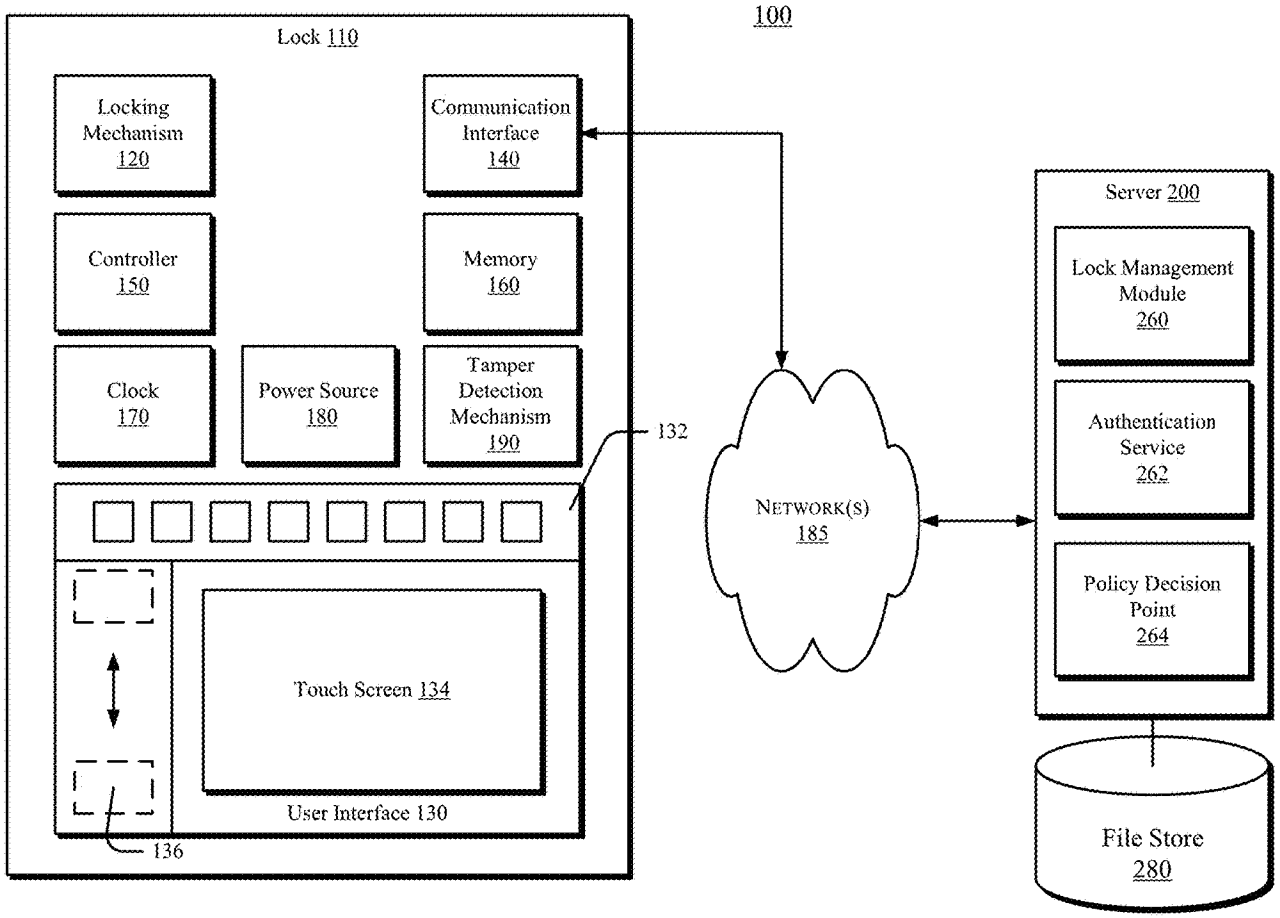
FIG. 1 is a schematic illustration of a system to manage access to a physical space, according to embodiments.

FIG. 1 is a schematic illustration of a system 100 to manage access to a physical space, according to embodiments. Referring to FIG. 1, includes a lock 110 which may be secured to a door to a room, a file cabinet, an equipment rack, or the like. In some examples the lock 110 may be separate from the physical structure to which it is secured and may operate like, for example, a padlock. In other examples the lock 110 may be integrated into the physical structure to which it is secured. For example, the lock may be an integral door lock.

Lock 110 comprises a locking mechanism 120 selectively positionable between a locked position and an unlocked position. For example, the locking mechanism may connect to a shackle, a bolt, or another structure.

Lock 110 further comprises a user interface 130 to receive user inputs to the lock 110. For example, user interface 130 may comprise a keypad comprising a plurality of keys or buttons 132 which may be used to enter alphanumeric characters and/or other input signals, a toggle switch 136 which may be toggled between multiple positions, and/or a touch screen display 134. In other examples user interface 130 may comprise a combination wheel through which a user may enter a combination for the lock 110. In further examples user interface 130 may comprise an input/output port, e.g., a universal serial bus (USB) port, a magnetic card reader, a wireless interface, a smart card reader, or the like through which a remote device may be coupled to lock 110.

Lock 110 further includes a communication interface 140, a controller 150, a computer readable memory 160, a clock 170, a power source 180, and a tamper detection mechanism 190. In some embodiments the communication interface 140 comprises at least one of a wired communication interface or a wireless communication interface. Examples of a wired interface may include an Ethernet interface (see, e.g., Institute of Electrical and Electronics Engineers/IEEE 802.3-2002) or a wireless interface such as an IEEE 802.11a, b or g-compliant interface (see, e.g., IEEE Standard for IT-Telecommunications and information exchange between systems LAN/MAN—Part II: Wireless LAN Medium Access Control (MAC) and Physical Layer (PHY) specifications Amendment 4: Further Higher Data Rate Extension in the 2.4 GHz Band, 802.11G-2003). Another example of a wireless interface would be a general packet radio service (GPRS) interface (see, e.g., Guidelines on GPRS Handset Requirements, Global System for Mobile Communications/GSM Association, Ver. 3.0.1, December 2002).

Controller 150 may be embodied as any type of computational element, such as but not limited to, a microprocessor, a microcontroller, a complex instruction set computing (CISC) microprocessor, a reduced instruction set (RISC) microprocessor, a very long instruction word (VLIW) microprocessor, or any other type of processor or processing circuit. Controller 150 may be a general purpose controller which is configured by logic instructions to perform specific purposes, a configurable controller such as, for example, a field programmable gate array (FPGA), or may be an application specific integrated circuit (ASIC) which includes logic that has been reduced to hard-wired circuitry. The specific implementation of controller 150 is not critical.

Memory 160 may comprise nonvolatile memory, e.g., magnetic or optical memory, or may include nonvolatile memory, e.g., 3-dimensional cross-point memory, flash memory, ferroelectric memory, silicon-oxide-nitride-oxide-silicon (SONOS) memory, polymer memory, memory, nanowire, ferroelectric transistor random access memory (FeTRAM or FeRAM), nanowire or electrically erasable programmable read-only memory (EEPROM). The specific implementation of memory 160 is not critical.

Clock 170 may comprise one or more logic circuits which are configured to measure time, e.g., by tracking rising and/or falling voltage levels in an integrated circuit or other techniques. Clock may be integrated into controller 150 or may be implemented as a separate logic device.

Power source 180 may comprise a power storage device, e.g., a battery or the like to provide electrical power to the lock 110. Alternatively, power source 180 may comprise a power adapter to allow the lock 110 to draw electrical power from a remote power supply.

Tamper detection mechanism 190 may comprise one or more logic circuits and/or physical sensors to detect tampering with the lock 110. E.g., a motion detector may generate a signal when violent motion is detected, or disruption of current through the lock's 110 shackle may signal invalid opening of the lock 110 or that the shackle has been cut In some embodiments the communication interface 140, controller 150, and memory 160 may be packaged onto a single integrated circuit (IC), which may be coupled to the user interface 130. In other embodiments the communication interface 140, controller 150, and memory 160 may be implemented as separate components communicatively coupled by a suitable communication connection.

Communication interface 140 is coupled to one or more communication networks 180. Communication network(s) 185, may be embodied as a direct connection, Personal Area Network (PAN), Local Area Network (LAN), Metropolitan Area Network (MAN) or a Wide Area Network (WAN), a proprietary communication network, or the like. Furthermore, communication networks 180 may comprise one or more sub-networks. By way of example, and not by limitation, communication networks 180 may comprise one or more access points (APs) that establish access to a LAN or directly to a backbone network such as the Internet. Additionally, the communication networks 180 may include a variety of input/output transports such as, but not limited to; wired USB or serial links, Wireless 802.11x link, wireless USB, Blue-tooth, infra red links, cellular networks, or the like.

Figure 2:
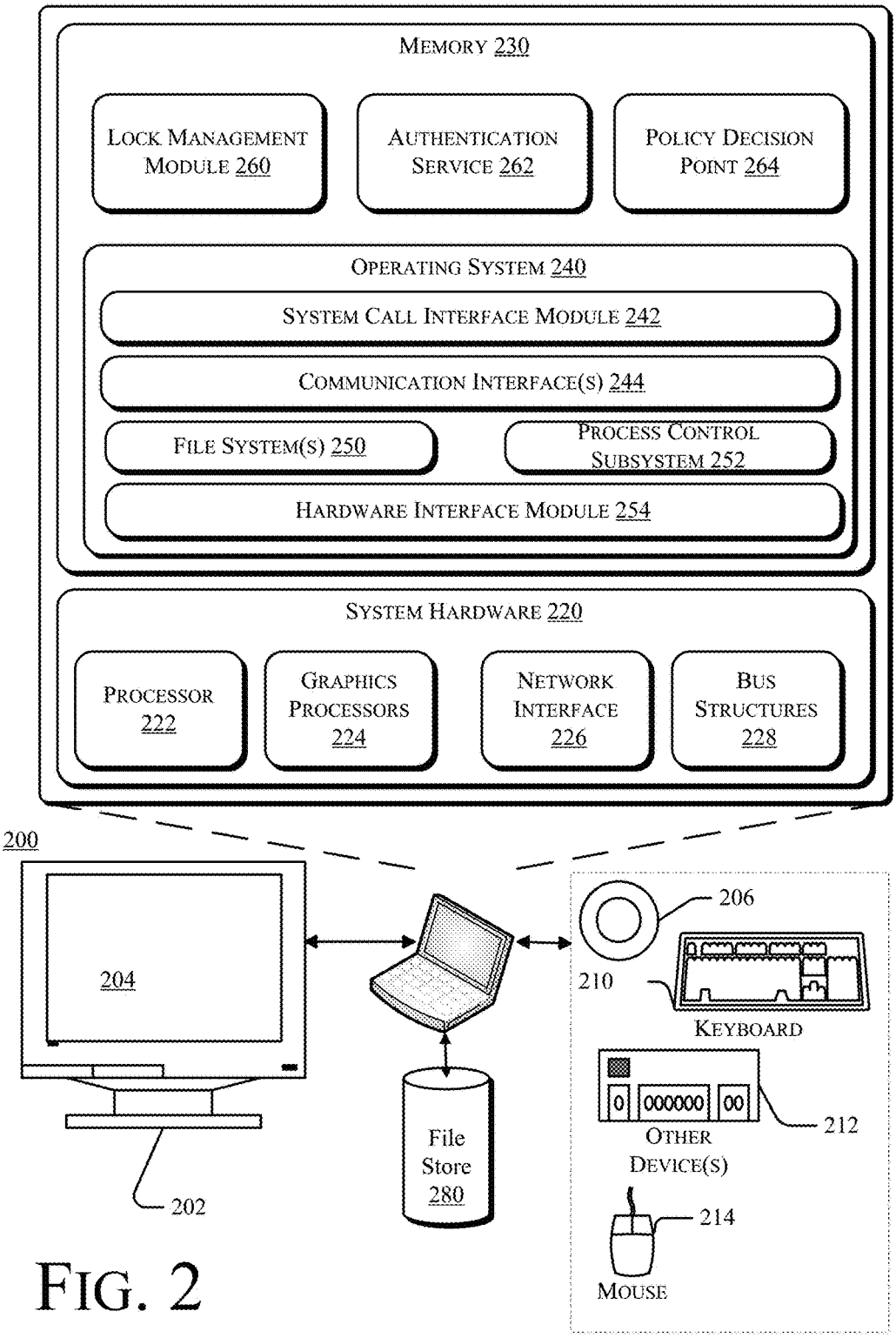
FIG. 2 is a schematic illustration of a computing device which may be adapted to implement systems and methods to manage access to a physical space in accordance with some embodiments.

One or more servers 200 are communicative coupled to network(s) 180. The server 200 may be embodied as a stationary computing device. FIG. 2 is a schematic illustration of a computing device 200. In one embodiment, a computing device 200 includes one or more accompanying input/output devices including a display 202 having a screen 204, one or more speakers 206, a keyboard 210, one or more other I/O device(s) 212, and a mouse 214. The other I/O device(s) 212 may include a touch screen, a voice-activated input device, a track ball, and any other device that allows the server 200 to receive input from a user.

The computing device 200 includes system hardware 220 and memory 230, which may be implemented as random access memory and/or read-only memory. A file store 280 may be communicatively coupled to server 200. File store 280 may be internal to server 200 such as, e.g., one or more hard drives, CD-ROM drives, DVD-ROM drives, or other types of storage devices. File store 280 may also be external to server 200 such as, e.g., one or more external hard drives, network attached storage, or a separate storage network.

System hardware 220 may include one or more processors 222, one or more graphics processors 224, network interfaces 226, and bus structures 228. As used herein, the term "processor" means any type of computational element, such as but not limited to, a microprocessor, a microcontroller, a complex instruction set computing (CISC) microprocessor, a reduced instruction set (RISC) microprocessor, a very long instruction word (VLIW) microprocessor, or any other type of processor or processing circuit.

Graphics processor(s) 224 may function as adjunct processor(s) that manages graphics and/or video operations. Graphics processor(s) 224 may be integrated onto the motherboard of computing system 200 or may be coupled via an expansion slot on the motherboard.

In one embodiment, network interface 226 could be a wired interface such as an Ethernet interface (see, e.g., Institute of Electrical and Electronics Engineers/IEEE 802.3-2002) or a wireless interface such as an IEEE 802.11a, b or g-compliant interface (see, e.g., IEEE Standard for IT-Telecommunications and information exchange between systems LAN/MAN—Part II: Wireless LAN Medium Access Control (MAC) and Physical Layer (PHY) specifications Amendment 4: Further Higher Data Rate Extension in the 2.4 GHz Band, 802.11G-2003). Another example of a wireless interface would be a general packet radio service (GPRS) interface (see, e.g., Guidelines on GPRS Handset Requirements, Global System for Mobile Communications/GSM Association, Ver. 3.0.1, December 2002).

Bus structures 228 connect various components of system hardware 220. In one embodiment, bus structures 228 may be one or more of several types of bus structure(s) including a memory bus, a peripheral bus or external bus, and/or a local bus using any variety of available bus architectures including, but not limited to, 11-bit bus, Industrial Standard Architecture (ISA), PCI, Micro-Channel Architecture (MSA), Extended ISA (EISA), Intelligent Drive Electronics (IDE), VESA Local Bus (VLB), Peripheral Component Interconnect (PCI), Universal Serial Bus (USB), Advanced Graphics Port (AGP), Personal Computer Memory Card International Association bus (PCMCIA), and Small Computer Systems Interface (SCSI), PCI Express (PCI-E) bus, Serial ATA (SATA) bus, or the like.

Memory 230 may include an operating system 240 for managing operations of computing device 208. In one embodiment, operating system 240 includes a hardware interface module 254 that provides an interface to system hardware 220. In addition, operating system 240 may include a file system 250 that manages files used in the operation of computing device 208 and a process control subsystem 252 that manages processes executing on computing device 208.

Operating system 240 may include (or manage) one or more communication interfaces that may operate in conjunction with system hardware 220 to transceive data packets and/or data streams from a remote source. Operating system 240 may further include a system call interface module 242 that provides an interface between the operating system 240 and one or more application modules resident in memory 230. Operating system 240 may be embodied as a Windows® brand operating system or as a UNIX operating system or any derivative thereof (e.g., Linux, Solaris, iOS, Android, etc.), or other operating systems.

In one embodiment, memory 230 includes a lock management module 260. Lock management module 260 may be embodied as logic instructions encoded in a tangible computer-readable medium. The lock management module 260, comprises logic instructions which, when executed by the processor 222, implement operations to allow a user to configure the lock 110 by interaction through a user interface such as a keyboard 210, a mouse 214, or some other user interface. By way of example, in some embodiments the lock 110 may be configured as a client node of the authentication service 262 and policy decision point 264. While the example illustrated in FIG. 1 shows a single lock 110, it will be appreciated that lock management module 260 may manage multiple locks 110.

In another embodiment, memory 230 includes an authentication service 262. Authentication service 262 may be embodied as logic instructions encoded in a tangible computer-readable medium. The authentication service 262 is capable of verifying user identity via various techniques including for example, by verifying a user-entered userID (i.e., a username) and password, by X.509 certificate authentication, by one-time password verification, or any other authentication technique, or combination of techniques.

The authentication service 262 may be implemented as a conventional directory service for an organization and may operate in accordance with existing directory service protocols, e.g., lightweight directory access protocol (LDAP), remote access dial in user service (RADIUS), or Microsoft active directory (AD). Alternatively, authentication service 262 may be implemented as any service capable of verifying users' identity claims.

In another embodiment, memory 230 includes a policy decision point 264. Policy decision point 264 may be embodied as logic instructions encoded in a tangible computer-readable medium. The policy decision point 264 is capable of evaluating codified policies governing for whom and under what conditions a user may open a lock 110, and generating a signal to a lock 110 indicating whether or not the lock 110 should open.

The policy decision point 264 may be implemented as a conventional directory service for an organization and may operate in accordance with existing directory service protocols, e.g., lightweight directory access protocol (LDAP), remote access dial in user service (RADIUS), or Microsoft active directory (AD). Alternatively, the policy decision point 264 may be implemented as a conventional authorization service in accordance with existing authorization protocols, e.g., eXtensible Access Control Markup Language (XACML), or any other service capable of processing codified access control policies.

It should be noted that the lock management module 260, the authentication service 262, and the policy decision point 264 may all reside on the same server 200, or on different servers 200, or in any combination on any number of servers 200. It should also be noted that the authentication service 262 and the policy decision point 264 could also be deployed as a single service (e.g., lightweight directory access protocol (LDAP), remote access dial in user service (RADIUS), or Microsoft active directory (AD)) capable of both user authentication and evaluation of codified access control policies.

Figure 3:
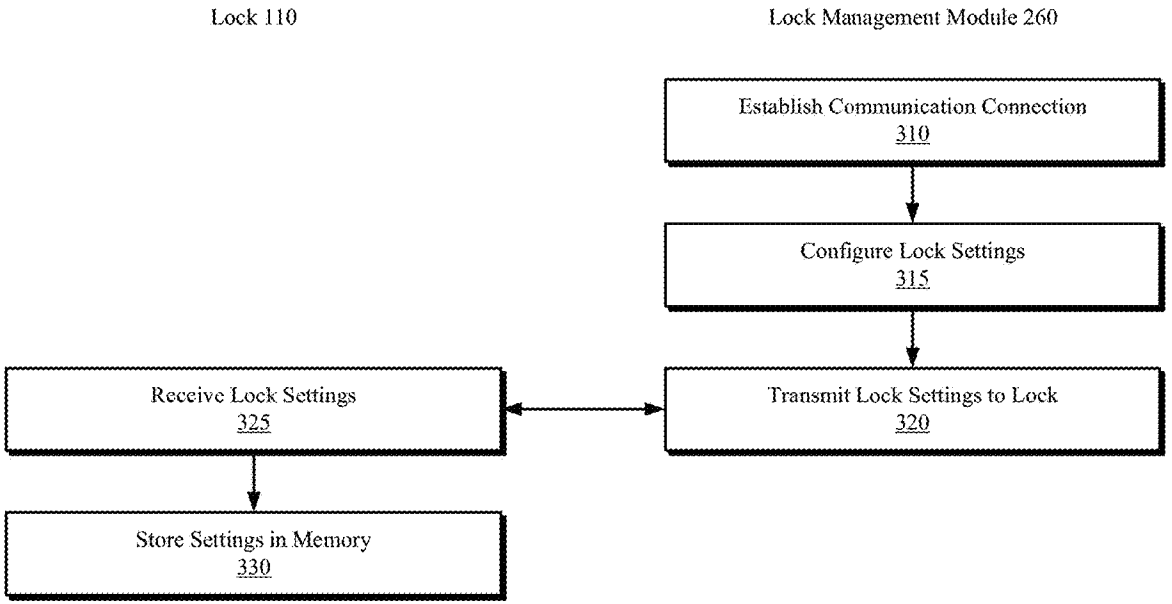
FIGS. 3 and 4A-4B are flowcharts illustrating operations in a method to manage access to a physical space according to embodiments.

FIG. 3 is a flowchart of operations which may be implemented by lock management module 260 to configure a lock 110. At operation 310 the lock management module 260 establishes a communication connection with a lock 110, e.g., via a communication network(s) 180. At operation 315 lock settings are configured. By way of example, in some embodiments the lock 110 may be configured by commands entered via a user interface on display 204 and issued to lock 110 via communication network(s) 180 which are then transmitted to lock 110 via communication network(s) 180. By way of example, the commands can be issued to lock 110 using https get commands. The results of submitting such commands may be returned to lock management module 260 in the form of return codes indicating the status of processing the commands at the lock 110. Among other things, the lock 110 may be configured with one or more authorization criteria which may be in the form of rules that control for whom the lock 110 will open. The authorization criteria may be stored in memory 160.

Table I presents a series of illustrative commands which may be used to configure various operating parameters of the lock 110 in its capacity as a client to an authentication service 262 and as a client to a policy decision point 264.

TABLE I

| Command | Attribute | Req/Opt | Default | Description |
|---|---|---|---|---|
| getLockID | | | | The only command supported without an accompanying lockKey. Returns a lock's lockID. This Command has no attributes. |
| getLockStatus | | | | Returns a lock's current configuration settings. |
| | lockKey | req | | the current lockKey value (hex digits) |

TABLE I-continued

| Command | Attribute | Req/Opt | Default | Description |
|---|---|---|---|---|
| unlockThelock | | | | Causes the lock to open |
| | lockKey | req | | the current lockKey value (hex digits) |
| lockTheLock | | | | Causes the lock to close and lock |
| | lockKey | req | | the current lockKey value (hex digits) |
| changeLockTime | | | | Enables setting a new time for the lock's internal clock. Or, maybe configure a network time server instead. |
| | lockKey | req | | the current lockKey value (hex digits) |
| | newTime | req | | the new time in |
| setLockBlocking | | | | Configures blocking of the lock; i.e., disabling the lock for some amount of time after consecutive failed attempts. |
| | LockKey | req | | the current lockKey value |
| | failedAttempts | req | | Number of consecutive failed attempts that will cause the lock to block. |
| | blockTime | req | | Time in seconds to block the lock. |
| setLockKey | | | | Enables setting a new administrative key for a lock. The administrative key should be at least 160 bits in length (at least 20 hex digits). |
| | lockKey | req | | the current lockKey value (hex digits) |
| | newLockKey | req | | the new lockKey value (hex digits) |
| setRemoteAdministration | | | | Enables a lock for remote administration |
| | lockKey | req | | the current lockKey value |
| | onOff | req | | on or off |
| | address | req if onoff is on | | IP address of the lock (and port) |
| | port | req if onoff is off | 443 | Network port on which the lock listens |
| | sourceIP | opt | null | comma-separated list of IP addresses allowed to connect to the lock. Null |

TABLE I-continued

| Command | Attribute | Req/Opt | Default | Description |
|---|---|---|---|---|
| | | | | allows any source IP to connect. Asterisk wild card is allowed. |
| setNetworkParams | | | | This command is used to configure a lock to communicate on the network. This may include wireless and/or physical connections. |
| setAuthnAuthz | | | | Sets the method of authentication and authorization the lock will use. |
| | lockKey | req | | the current lockKey value |
| | method | req | | combination, ldapbind, radius, cert |
| | twoPerson | opt | off | on or off - if on, then two authentications are required to open the lock. |
| | combination | req if method is combination | | the combination to open the lock |
| | ldapServer | req if method is ldapbind | | server DNS or IP address of LDAP server |
| | ldapPort | req if method is ldapbind | 389 | the network port on which the LDAP server listens |
| | ldapSecure | req if method is ldapbind | off | off, ssl, or tls |
| | ldapCerts, | req if ldapsecure is ssl or tls | | comma-separated list of LDAP server certificates and/or signing certs to trust. |
| | ldapBindDN | req if method is ldapbind | | bindDN to use to connect to LDAP |
| | ldapBindPwd | req if method is ldapbind | | Password to use to connect to LDAP |
| | ldapBase | req if method is ldapbind | | search base for where to begin looking for users. |
| | ldapScope | req if method is ldapbind | sub | base, one, or sub - controls how deep below the search base to search for the userID. |
| | ldapUidAttribute | req if method is ldapbind | | the LDAP attribute in which the userID is stored. |
| | ldapFilter1 | req if method is ldapbind | | ldap filter - authenticated users matching the filter will |

TABLE I-continued

| Command | Attribute | Req/Opt | Default | Description |
|---|---|---|---|---|
| | | | | be able to unlock the lock (or half unlock the lock in two person control configurations). |
| | ldapFilter2 | req if method is ldapbind and twoperson is on | | ldap filter - authenticated users matching the filter will be able to half unlock the lock (the other half must be performed by someone matching ldapfilter1). |
| | radius . . . | req if method is radius | | set of attributes to enable RADIUS authentication & authorization. |
| | cert . . . | req if method is X.509 certificate | req if method is cert | set of attributes to enable certificate authentication & authorization. (Note: authorization may leverage LDAP or RADIUS configuration settings) |
| setAuthnThreshold | | | | Disables the lock for a userID |
| | lockKey | req | | the current lockKey value (hex digits) |
| | threshold | req | 0 | 0 thru 9. 0 indicates no authentication error threshold. Non-zero causes the lock to be disabled for a userID with this number of consecutive authentication failures. |
| setNotifications | | | | Causes the lock to send email notifications for configured events. |
| | lockKey | req | | the current lockKey value (hex digits) |
| | onOff | req | | on or off. If off, all other attributes are ignored. |
| | emailAddress | req if onoff is on | | email address to which notifications are sent. |
| | notifyUnlock | opt | off | on or off Sends email notifying of unlock event |

TABLE I-continued

| Command | Attribute | Req/Opt | Default | Description |
|---|---|---|---|---|
| | notifyLock | opt | off | on or off Sends email notifying of lock event |
| | notifyBatteryLow | opt | off | on or off. Sends email notifying of low battery |
| | notifyTimeCreep | opt | 60 | number of seconds - sends email notifying internal clock variance from network time by more than number of seconds |
| | notifyBlock | opt | off | on or off. Sends email notifying of blocking of lock. |
| | notifyConfig | opt | off | on or off. Sends email notifying of configuration changes. |
| | notifyAuthnThreshold | opt | off | on or off. Sends email when a userID reaches the configured number of consecutive authentication errors. |
| | notifyTamperDetection | opt | off | on or off. Sends email notifying of activity at the lock that triggers tamper detection sensors. |

At operation 325 the lock 110 may receive the lock configuration settings and at operation 330 the lock configuration settings may be stored in memory 160. Certain of the lock configuration settings, notably the authorization criteria governing the opening of the lock 110, may alternatively be stored in some file store 280 accessible to the policy decision point 264, and indexed with an identifier of the lock 110 to which the criteria pertain.

While the example illustrated in FIG. 1 shows a single lock, it will be appreciated that lock management module 260 may manage multiple locks. The lock management module 260 may include a list of lockIDs and corresponding lockKeys, and other configuration settings which may be stored in memory 230 and/or in the file store 280.

Figure 4A:
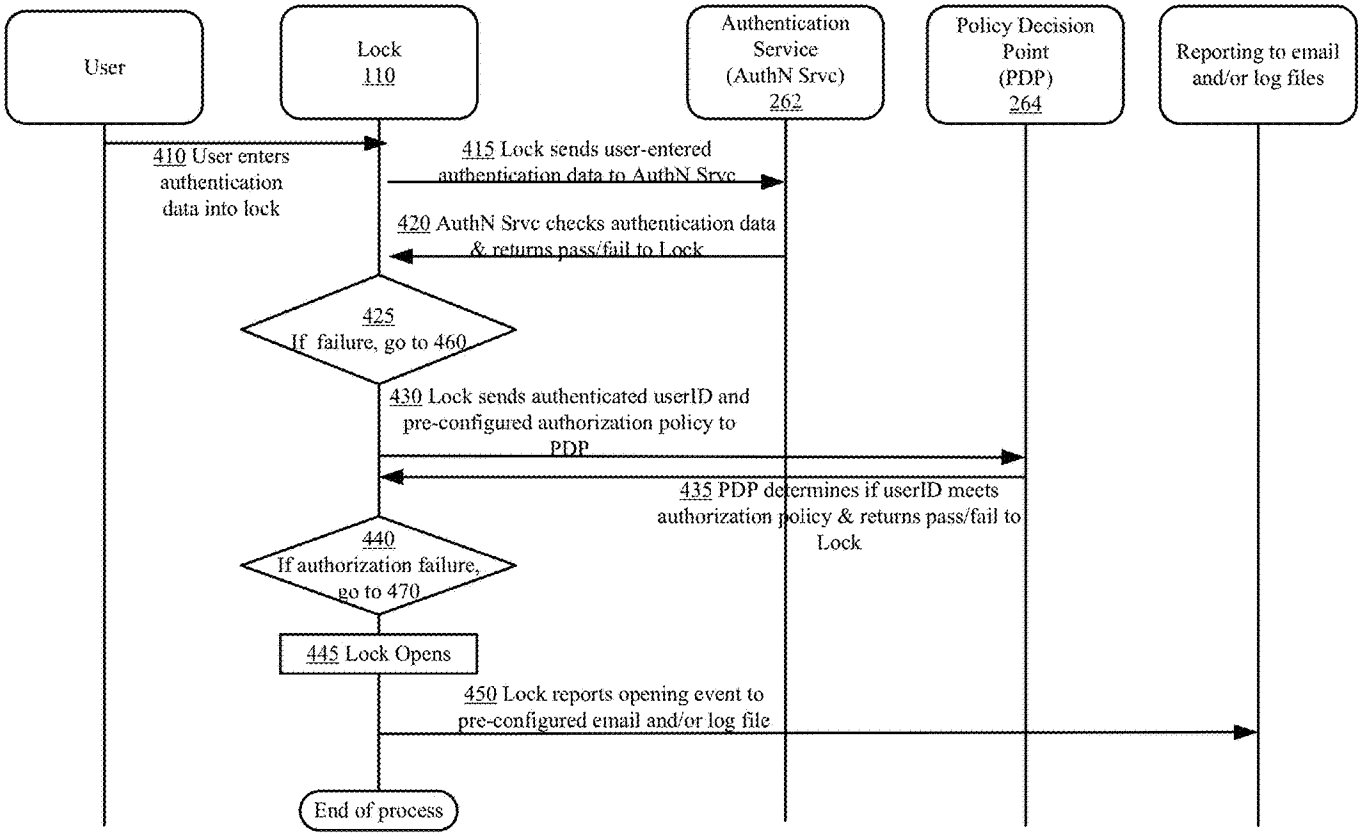
Figure 4B:
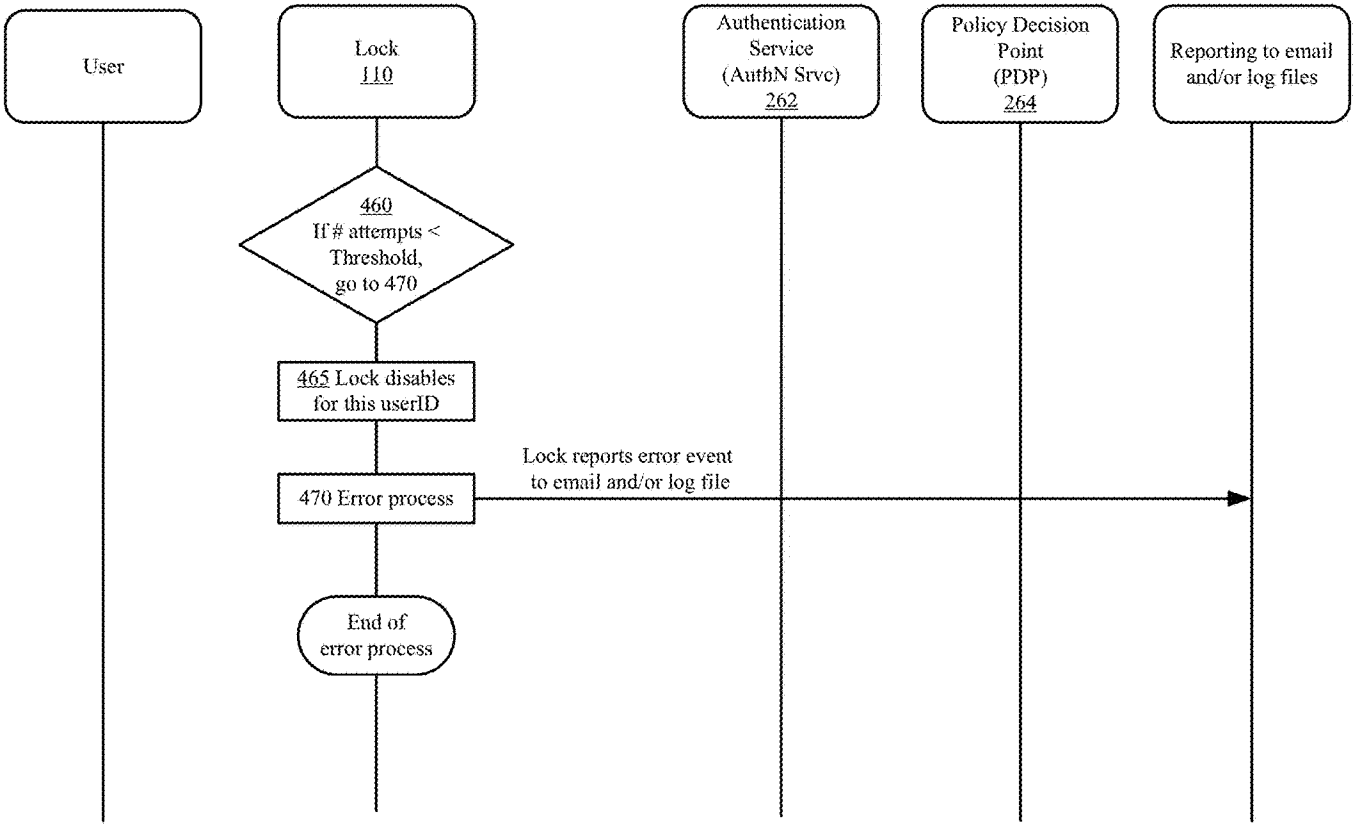

Once the lock 110 has been configured as a directory service client to authentication service 262 and policy decision point 264 the lock 110 can be deployed. FIGS. 4A and 4B are flowcharts which illustrate a possible sequence of operations in an interaction between by the lock 110 and the authentication service 262 and policy decision point 264 in a method to manage access to a physical space secured by the lock 110. By way of example, lock 110 may be implemented as a padlock which secures a door to a room or a cabinet or as a lock integrated into a door or cabinet.

At operation 410 lock 110 receives authentication data via a user input. In some embodiments a user may provide a user input which uniquely identifies the user, e.g., a username and a password or other identifying information. The user input may be provided through interaction with the user interface 130 or via a device such as a USB memory device, a magnetic card, a smart card, and/or the like which may communicate with lock 110.

At operation 415 the lock 110 sends an authentication request comprising authentication data received at operation 410 to the authentication service 262. By way of example, the authentication request may include a username/password combination or some other authentication data entered in operation 410.

At operation 420 the authentication service 262 attempts to verify the authentication data received at 410, and reports the success or failure (pass/fail) of the verification back to lock 110.

At operation 425 the lock 110 determines which logic to execute based upon the pass/fail signal received at 420. If a failure signal was received at 420, then the lock 110 will invoke an error process beginning at 460. Otherwise the lock 110 proceeds with 430.

At operation 430 the lock 110 submits to the policy decision point 264 the authenticated userID along with one or more authorization criteria which embody rules governing who can open the lock 110. The authorization request may include other information, e.g., a timestamp, a location coordinate, or the like. The authorization criteria may have been previously configured into the lock 110 at operation 325. If the lock's 110 authorization policy has been stored in a file store 280 accessible to the policy decision point 264, the lock 110 could alternatively submit to the policy decision point 264 the authenticated userID along with its own LockID which could then be used by the policy decision point 264 as an index to locate the lock's 110 authorization policy in the file store 280.

At operation 435 the policy decision point 264 determines if properties associated with the authenticated userID meets the configured authorization policy for that lock 110. The policy decision point 264 may either use the authorization policy obtained in 430, or may use a lockID obtained in 430 as an index to locate the lock's 110 authorization policy in a file store 280. The policy decision point 264 then returns the success or failure (pass/fail) of the authorization determination to the lock 110. By way of example, if the authorization criteria specify that only people associated with a particular work group or project are authorized to open the lock then the policy decision point 264 will determine whether the authenticated userID is associated with the particular work group or project.

At operation 440 the lock 110 determines which logic to execute based upon the pass/fail signal received at 435. If a failure signal was received at 435, then the lock 110 will invoke an error process beginning at 470. Otherwise the lock 110 proceeds with 445.

At operation 445 the lock 110 opens for the authenticated and authorized user.

At operation 450 the lock 110 reports the opening event by sending an unlock notification to pre-configured email and/or log file destinations.

Referring to FIG. 4B, operation 460 occurs when user authentication errors have occurred. The lock 110 retrieves from its own memory 160 the configured threshold for consecutive authentication errors, and checks its own memory 160 for the number of attempts to open the lock which result in consecutive authentication errors for this userID. If the number of consecutive authentication errors for this user meets the configured threshold, then control proceeds with operation 465. If the number of consecutive authentication error for this user does not exceed a configured threshold, then control passes to operation 470.

At operation 465, the lock 110 may be disabled for the user ID that was received with the user input in operation 410. The lock 110 may remain disabled for a predetermined period of time or until a reset operation is executed by an administrator.

At operation 470 the lock 110 implements an error process. By way of example, an error process may include presenting an error message and/or an error indicator on user interface 130, declining to open the lock 110, reporting the error and/or a lock notification to another remote computing system and or a pre-configured email address.

In some embodiments the lock 110 may require a successful login from two users to open the lock 110. In such embodiments the controller 150 may be configured to repeat the process depicted in operations 410 through 470 with input from a second user before opening the lock 110.

Thus, described herein are systems and methods to manage access to a physical space. In some embodiments a lock 110 may be equipped with a controller 150 which may be configured to function as a client of an existing authentication service 162 and policy decision point 164 for an organization. The controller 150 may be further configured with rules which govern opening of the lock 110 and may provide these rules to a policy decision point 264. Based upon response from the authentication service 162 and the policy decision point 264, the controller may open the lock 110 if the user is authenticated and authorized to open the lock 110.

In the foregoing discussion, specific implementations of exemplary processes have been described, however, it should be understood that in alternate implementations, certain acts need not be performed in the order described above. In alternate embodiments, some acts may be modified, performed in a different order, or may be omitted entirely, depending on the circumstances. Moreover, in various alternate implementations, the acts described may be implemented by a computer, controller, processor, programmable device, firmware, or any other suitable device, and may be based on instructions stored on one or more computer-readable media or otherwise stored or programmed into such devices (e.g. including transmitting computer-readable instructions in real time to such devices). In the context of software, the acts described above may represent computer instructions that, when executed by one or more processors, perform the recited operations. In the event that computer-readable media are used, the computer-readable media can be any available media that can be accessed by a device to implement the instructions stored thereon.

In various embodiments, one or more of the operations discussed herein, e.g., with reference to FIGS. 3-4, may be implemented as hardware (e.g., logic circuitry), software, firmware, or combinations thereof, which may be provided as a computer program product, e.g., including a machine-readable or computer-readable medium having stored thereon instructions used to program a computer to perform a process discussed herein. The machine-readable medium may include any suitable storage device such as those discussed with reference to FIGS. 3 and 4.

Reference in the specification to "one embodiment" or "an embodiment" means that a particular feature, structure, or characteristic described in connection with that embodiment may be included in at least one implementation. The appearances of the phrase "in one embodiment" in various places in the specification may or may not be all referring to the same embodiment.

Also, in the description and claims, the terms "coupled" and "connected," along with their derivatives, may be used. In some embodiments, "connected" may be used to indicate that two or more elements are in direct physical or electrical contact with each other. "Coupled" may mean that two or more elements are in direct physical or electrical contact. However, "coupled" may also mean that two or more elements may not be in direct contact with each other, but may still cooperate or interact with each other.

Thus, although embodiments of the invention have been described in language specific to structural features and/or methodological acts, it is to be understood that claimed subject matter may not be limited to the specific features or acts described. Rather, the specific features and acts are disclosed as sample forms of implementing the claimed subject matter.

What is claimed is:

1. A lock, comprising:

a locking mechanism selectively positionable between a locked position and an unlocked position;

a user interface configured to receive a first user input that identifies a first user;

a communication interface configured to enable electronic communication with a remote computer system; and a controller configured to:

transmit a query to a directory service, wherein the query comprises first user input data based on the first user input;

receive a first signal from the directory service indicating that the first user is authorized to open the lock;

determine whether a set of conditions are satisfied by:

transmitting a second query to a policy decision server, wherein the policy decision server is distinct from the directory service, and wherein the second query comprises the first user input and authorization policy data that identifies the set of conditions; and receiving a second signal from the policy decision server indicating whether the set of conditions are satisfied; and open the locking mechanism in response to the first signal and in response to determining that the set of conditions required to open the lock are satisfied.

2. The lock of claim 1, wherein the user interface includes a touch screen user interface.

3. The lock of claim 1, wherein the authorization policy data includes a lock identifier, wherein the policy decision server obtains the set of conditions from a database based on the lock identifier, and wherein the database is distinct from the policy decision server.

4. The lock of claim 1, wherein the locking mechanism comprises a shackle, wherein a current is run through the shackle when the locking mechanism is in the locked position, wherein the current is not run through the shackle when the locking mechanism is in the unlocked position, and wherein a signal is transmitted to the controller when the current is disrupted while the set of conditions are not satisfied.

5. The lock of claim 1, wherein the controller is configured to implement an error process in response to a third signal from the directory service indicating that the first user is not authorized to open the lock or in response to determining that the set of conditions required to open the lock are not satisfied, and wherein the error process comprises presenting an error indicator on the user interface.

6. The lock of claim 1, further comprising a motion detector configured to generate a signal to the controller when a particular motion is detected.

7. The lock of claim 1, wherein the controller is configured to transmit an unlock notification to a second remote computer system in response to the locking mechanism entering the unlocked position.

8. The lock of claim 1, wherein the controller is configured to transmit a lock notification to a second remote computer system in response to the locking mechanism entering the locked position.

9. The lock of claim 1, wherein the controller is configured to disable unlocking the lock for the first user after a particular number of failed attempts to open the lock using the first user input, and wherein unlocking the lock remains enabled for a second user identified by a second user input after the particular number of failed attempts to open the lock fail using the first user input.

10. The lock of claim 9, wherein the controller is configured to transmit an error notification to a second remote computer system in response to the controller disabling unlocking the lock for the first user.

11. A computer-based system comprising:

a processor;

a non-transitory memory comprising instructions which, when executed by the processor, cause the processor to perform operations comprising:

transmitting a query to a directory service, wherein the query comprises first user input data based on first user input that identifies a first user;

receiving a first signal from the directory service indicating that the first user is authorized to open a lock;

determining whether a set of conditions are satisfied by:

transmitting a second query to a policy decision server, wherein the policy decision server is distinct from the directory service, and wherein the second query comprises the first user input and authorization policy data that identifies the set of conditions; and receiving a second signal from the policy decision server indicating whether the set of conditions are satisfied; and opening a locking mechanism in response to the first signal and in response to determining that the set of conditions required to open the lock are satisfied.

12. The computer-based system of claim 11, wherein the first user input is authenticated by the directory service when a first user name and a first password indicated by the first user input data matches a second user name and a second password in a directory stored at the directory service.

13. The computer-based system of claim 12, wherein the operations further comprise receiving a third signal indicating that the first user is not authorized to open the lock when the first user name and the first password do not match any user name and password combination in the directory.

14. The computer-based system of claim 12, wherein the set of conditions includes a particular property associated with the first user name that is required to open the lock.

15. The computer-based system of claim 14, wherein the particular property is the first user name being associated with a work group, and wherein the particular condition requires the first user name to be associated with the work group.

16. The computer-based system of claim 14, wherein the particular property is the first user name being associated with a project, and wherein the particular condition requires the first user name to be associated with the project.

17. The computer-based system of claim 11, further comprising:

transmitting a third query to the directory service, wherein the third query comprises second user input data based on a second user input at the lock; and receiving a third signal from the directory service indicating that a second user identified by the second user input data is authorized to open the lock, wherein the set of conditions indicate that the first user and the second user are both to be authenticated for the lock to be opened, and wherein the second query includes the second user input data.

18. The computer-based system of claim 11, wherein the operations further comprise, prior to transmitting the query, receiving a set up command from the directory service.

19. A method comprising:

receiving a first user input via a user interface of a lock, wherein the first user input identifies a first user;

transmitting, from the lock, a query to a directory service, wherein the query comprises first user input data based on the first user input;

receiving, at the lock, a first signal from the directory service indicating that the first user is authorized to open the lock;

determine, at the lock, whether a set of conditions are satisfied by:

transmitting a second query to a policy decision server, wherein the policy decision server is distinct from the directory service, and wherein the second query comprises the first user input and authorization policy data that identifies the set of conditions; and receiving a second signal from the policy decision server indicating whether the set of conditions are satisfied; and opening a locking mechanism in response to the first signal and in response to determining that the set of conditions required to open the lock are satisfied.

20. The method of claim 19, further comprising transmitting an unlock notification to a remote computer system in response to the locking mechanism entering an unlocked position.

* * * * *